US005277127A

United States Patent [19]

Euwijk et al.

[11] Patent Number: 5,277,127

[45] Date of Patent: Jan. 11, 1994

[54] DRIVEN RUNNING GEAR WITH STEERABLE INDIVIDUAL UNITS

[75] Inventors: Willi V. Euwijk, Pratteln; Gabor Harsy, Neuhausen am Rheinfall, both of Switzerland

[73] Assignee: SIG Schweizerische Industrie Gesellschaft, Switzerland

[21] Appl. No.: 962,034

[22] Filed: Oct. 15, 1992

Related U.S. Application Data

[63] Continuation of Ser. No. 656,159, filed as PCT/CH90/00195, Aug. 17, 1990, abandoned.

[30] Foreign Application Priority Data

Aug. 21, 1989 [CH] Switzerland ..... 03042/89

[51] Int. Cl.[5] ..... B61F 3/12

[52] U.S. Cl. ..... 105/176; 105/133; 105/168; 105/453

[58] Field of Search ..... 105/133, 138, 158.2, 105/453, 167, 168, 169, 157.1, 176, 4.2

[56] References Cited

U.S. PATENT DOCUMENTS

| | | | |
|---|---|---|---|
| 2,056,219 | 10/1936 | Stout et al. | 105/133 |
| 2,908,233 | 10/1959 | Furrer | 105/453 |
| 2,921,539 | 1/1960 | Furrer | 105/168 |
| 2,968,258 | 1/1961 | Lich | 105/453 |
| 3,682,103 | 8/1972 | Schwam | 105/453 |
| 3,961,582 | 6/1976 | Paton et al. | 105/176 |
| 4,625,652 | 12/1986 | Losa et al. | 105/4.1 |

FOREIGN PATENT DOCUMENTS

| | | |
|---|---|---|
| 263793 | 4/1988 | European Pat. Off. . |
| 8505602 | 12/1985 | World Int. Prop. O. . . |

*Primary Examiner*—Robert J. Oberleitner
*Assistant Examiner*—Kevin D. Rutherford
*Attorney, Agent, or Firm*—Ostrolenk, Faber, Gerb & Soffen

[57] ABSTRACT

The driven running gear is intended for low-platform rail vehicles with at least two body parts which are articulated to each other. It is provided with two individual running gears (2, 2') fitted with steering means (15, 15', 16). The running gears are interconnected to pivot about their horizontal axis beneath the axial center of the wheels (8, 8') by a connecting member (3). The connecting member has at its ends transversely directed support arms (4, 4') for the support of a body part. On the latter there are fastened at least one motor (21, 21') and a brake (23, 23', 24, 24') which drive and brake the running gear (1) via telescopic universal shafts (25, 25') and bevel gearings (26, 26') arranged on the outside of the wheels on both individual running gears (2, 2'). In this way, upon travel around a curve, the angle of bend formed between a leading body part in the direction of travel under which such a running gear is located and a trailing body part which is also supported on an axle is transmitted to the steerable individual running gears so that the desired curve-radial position of the pairs of wheels results.

26 Claims, 9 Drawing Sheets

DRIVEN RUNNING GEAR WITH STEERABLE INDIVIDUAL UNITS

This is a continuation of application Ser. No. 07/656,159 filed as PCT/CH90/00195, Aug. 17, 1990 now abandoned.

BACKGROUND OF THE INVENTION

The present invention relates to a driven running gear having two individual running gears which are connected to each other and mutually steerable for low-platform rail vehicles, particularly for articulated vehicles which consist of at least two body parts articulated to each other, in which a steering linkage transmits the angle of bend of the body parts to the running gear in order to place the individual running gears in proper curve-radial position.

Convenient entrance conditions and a lover vehicle floor resulting therefrom which extends continuously over the entire length of the vehicle, are some of the essential demands made by the passengers with respect to the comfort of modern rail vehicles, particularly in municipal transit.

Furthermore, from the standpoint of the operator, stable straight-ahead travel and wear-free travel around curves are desired, this latter being closely related to the elimination of the screeching upon travel over curves which is found disturbing.

Further objects are light weight and reduction of the investment costs, for instance by reducing the number of axles for the same capacity of the vehicles.

In accordance with the prior art, it was attempted already at an early time to do away, in such light-weight construction articulated vehicles, with pivoted trucks which, due to their central loading, result in heavy truck frames.

Known older embodiments either employ for this purpose the so-called association steering axle or else provide a body part without axle which connects the two axle-supported body parts pivotally to each other.

In most cases, in these solutions, as a result of the play present in the axle bearing guides and the steering as well as the partial absence of damping, a rolling movement occurs in the form of a sinusoidal turning movement around the vertical axis, which results in unsteady travel of the vehicles.

Recently there has become known from European Application EP-(A2) 0 263 793 a running gear which, conceived of as a motorized two-axle truck, due to its low cranked-axle construction, accommodates use below a central body part or below the articulation, of low-platform rail vehicles having two or more articulated body parts.

For this purpose, in each case, two idle wheels are connected with an axle bridge which is arranged below their axle center points and is developed otherwise substantially in L-shape and is suspended in each case at the end of its length-wise girder-like arm in rotary symmetry to a diametrically opposite axle bridge which bears the second pair of idle wheels, articulately in vertical direction from an unsprung truck frame. Each of the axle bridges serves in its center to receive a central air spring, both of said springs having a multipartite rotary articulation on their top. The two outwardly directed end body parts as well as an undercarriage supporting frame which connects the two air springs and serves a central body part are supported therein, swingable around the vertical axis, the said supporting frame being pivoted in longitudinal direction via links to the axle bridges.

The drive equipment consists in each case of a motor which lies longitudinally between two pairs of idle wheels and is yieldably mounted on the unsprung truck frame together with secondary drive on both sides to the idle wheels, in which connection the transmission of force is effected by articulated shafts to bevel gearings with spur differential gearing which are arranged outside on the axle stubs. The brake equipment, consisting of block and magnetic rail brakes is also suspended from the unsprung truck frame.

The disadvantages reside essentially in the fact that the solution indicated is directed towards the construction of a truck in which neither curve-dependent control by at least one of the body parts is provided nor is radial setting of the wheels upon travel over a curve possible. Furthermore, the truck frame disclosed there, as well as all important attached parts such as motors and brakes, form a part of the unsprung mass of the truck.

Furthermore, from international application WO 85/05 602 a solution is known in which two idle-wheel individual running gears are detachably connected to each other by their integrated, rigid short-coupling parts and in this way form a four-wheel unmotorized running gear which by its low, cranked-axle construction permits the use below or adjacent to an articulation part of low-platform rail vehicles having at least two body parts.

For this purpose, in each case two idle wheels are connected with an axle bridge which is arranged below their axle center points, which bridge otherwise has a rigid coupling part and with it surrounds in longitudinally displaceable manner the rigid coupling part of an axle bridge which is diametrically opposite with mirror symmetry and bears the second pair of idle wheels. The axle bridges serve to receive in each case in their center a central air spring, the springs being turnable at their lower side on a ball turning ring and bearing on their top the corresponding end body parts via supporting arms by means of an annular support which has a combined axial/radial bearing into which the pivot pin of the articulation floor part engages. The annular supports of both end body parts are connected together via a rod coupling, the couplings being pivoted in longitudinal direction via links to the two telescopically insertable coupling parts which are arranged rigidly on the axle bridges. Furthermore, the end body parts are connected to the axle bridges by wobble supports.

The brake equipment consists of outside disc brakes the brake discs of which are arranged on the axle stubs, the brake actuation parts being suspended unsprung from a support of the axle bridge.

The disadvantages reside essentially in the fact that in the solution indicated neither curve-dependent control by at least one of the body parts is provided nor is radial adjustability of the wheels upon travel over a curve possible and, furthermore, the brake system indicated forms part of the unsprung mass.

Another disadvantage is that the height of the floor in the region of the (motorized) end trucks is raised by steps arranged transverse to the direction of travel.

Due to the disadvantages of the solutions indicated in the prior art, not only is the wheel/rail wear unfavorably influenced and the screeching around curves not eliminated but, furthermore, all accelerations of the wheel/rail contact are conducted directly and unsprung into load-bearing structural parts as well as their attachments, which, as is known, leads to undesirably high stresses there. Cracks or even the breaking of load-supporting parts are the result. By thread connections which become loose, individual parts which are of importance for operation are not infrequently lost upon travel. This endangers the safety and/or the proper operation in such a manner that the failure of the vehicle is finally brought about.

SUMMARY OF THE INVENTION

The general object of the invention is to remedy the above-mentioned defects of the prior art.

A more specific object therefore is to create a simple and light driven running gear of low unsprung mass for low-platform rail vehicles, particularly for articulation vehicles in which at least two axle-supported body parts are pivotally connected to each other and the angle of bend of the body parts is used for the setting of the pairs of wheels in correct radial position on the running gear.

In accordance with the invention, such a driven running gear is characterized by the fact that two individual running gears of a low cranked-axle construction which can be steered in directions opposite to each other are connected together and bear the corresponding body part of a low-platform articulated vehicle consisting of at least two body parts and via motors suspended from said body part and reduction gears accelerate the articulated vehicle or, via suspended brakes, decelerate it, a steering linkage with a corresponding step-up ratio for the setting in correct radial position of the individual running gears transmitting the angle of bend of the body parts to the running gear.

In this way, upon travel around curves, the angle of bend, which is established between a body part leading in the direction of travel and below which a running gear in accordance with the invention is located, and a trailing body part which for instance is also axle-supported, is transmitted to the steerable individual running gears so that the desired radial position around curves of the pairs of wheels results. Similarly, the detecting of the angle of bend resulting upon travel around a curve can also be effected between two axle-supported body parts which are pivotally connected to each other by an axle-free body part, a running gear in accordance with the invention again being present in each case under said body parts.

As compared with comparable articulated vehicles which are equipped with known trucks, there is thus obtained a reduction in the number of sets of running gears, which goes hand in hand with a substantial reduction in weight and consequently represents a reduction in cost of purchase and maintenance. This trend is further increased by the simple and light construction of the running gear of the invention. To this there contribute both the adjustability in radial position of individual running gears upon travel around curves as well as the fact that the drive and brake equipment is suspended from the axle-supported body part.

Further embodiments of the running gear of the invention furthermore permit a two-stage springing of the steerable sets of individual running gears, whereby the unsprung masses are reduced to a minimum.

Further advantages of the solution in accordance with the invention are as follows:

The flexurally stiff connection between the two steerable individual running gears is torsionally soft and thus satisfies all requirements as to safety against derailing with respect to non-uniform wheel pressures or changes in wheel load as a result of travel around curves upon winding portions of tracks.

By the special development - serving also for support of the body - of the connection of the two individual running gears, the turning-out movement upon travel along curves is kept away from the body spring suspension and thus the resistance to turning out is reduced to a minimum.

The supporting of the body part is obtained over a broad base so that additional wobble stabilizers can be dispensed with.

Forces of reaction from drive and brakes as well as differences in wheel diameters are taken up by the system and, for instance, leave the adjustability in radial position upon curves unaffected.

For the mutual control of the radial position of the two individual running gears which are connected to each other, the most different known steering linkages can be used, as desired.

BRIEF DESCRIPTION OF THE DRAWINGS

The invention will be explained by way of example with reference to the following figures of the drawing, in which.

DETAILED DESCRIPTION OF EMBODIMENTS OF THE INVENTION

Figure 1:
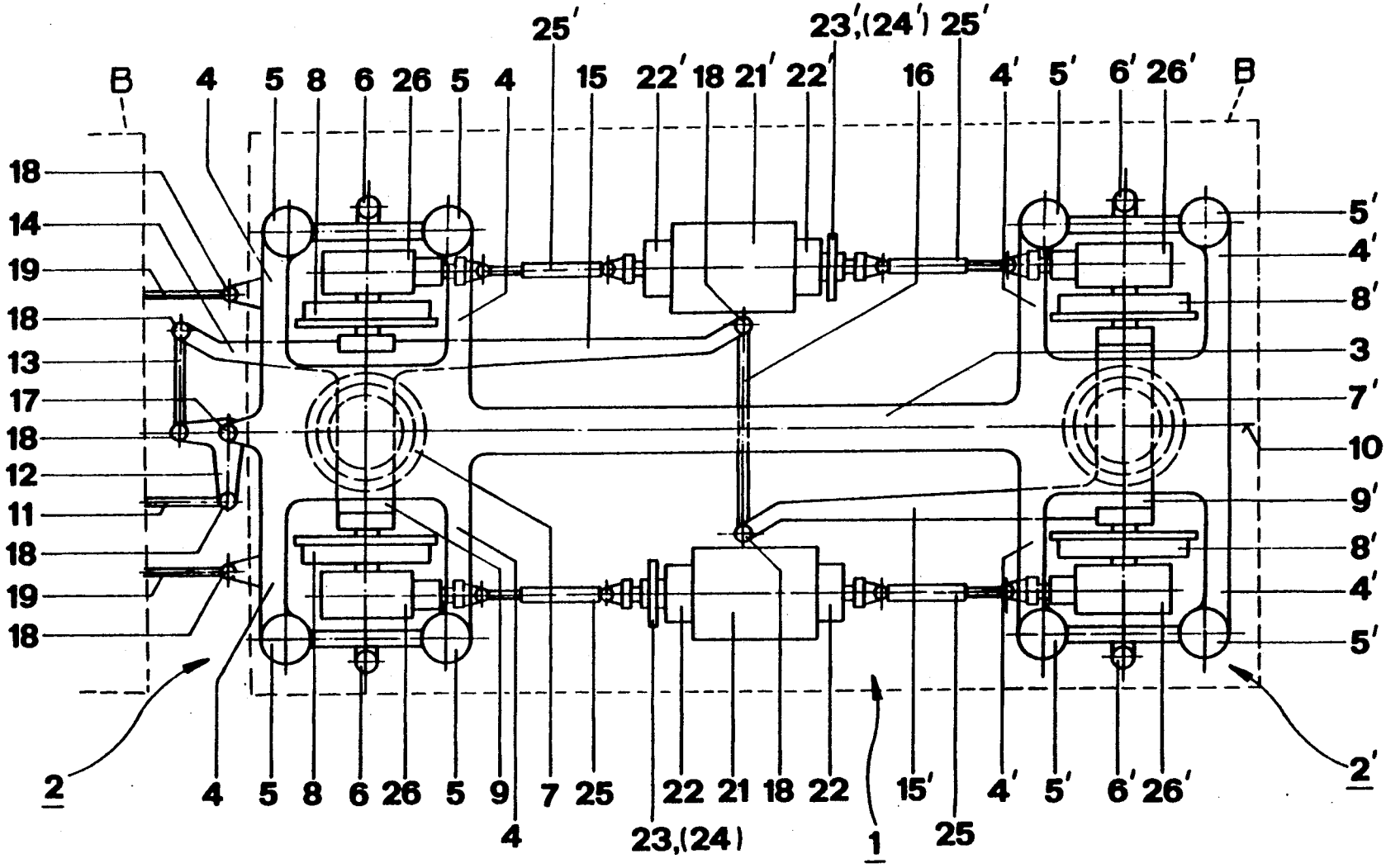
FIG. 1 shows a running gear which is driven from both sides with individual-wheel running gears, seen in top view.
Figure 2:
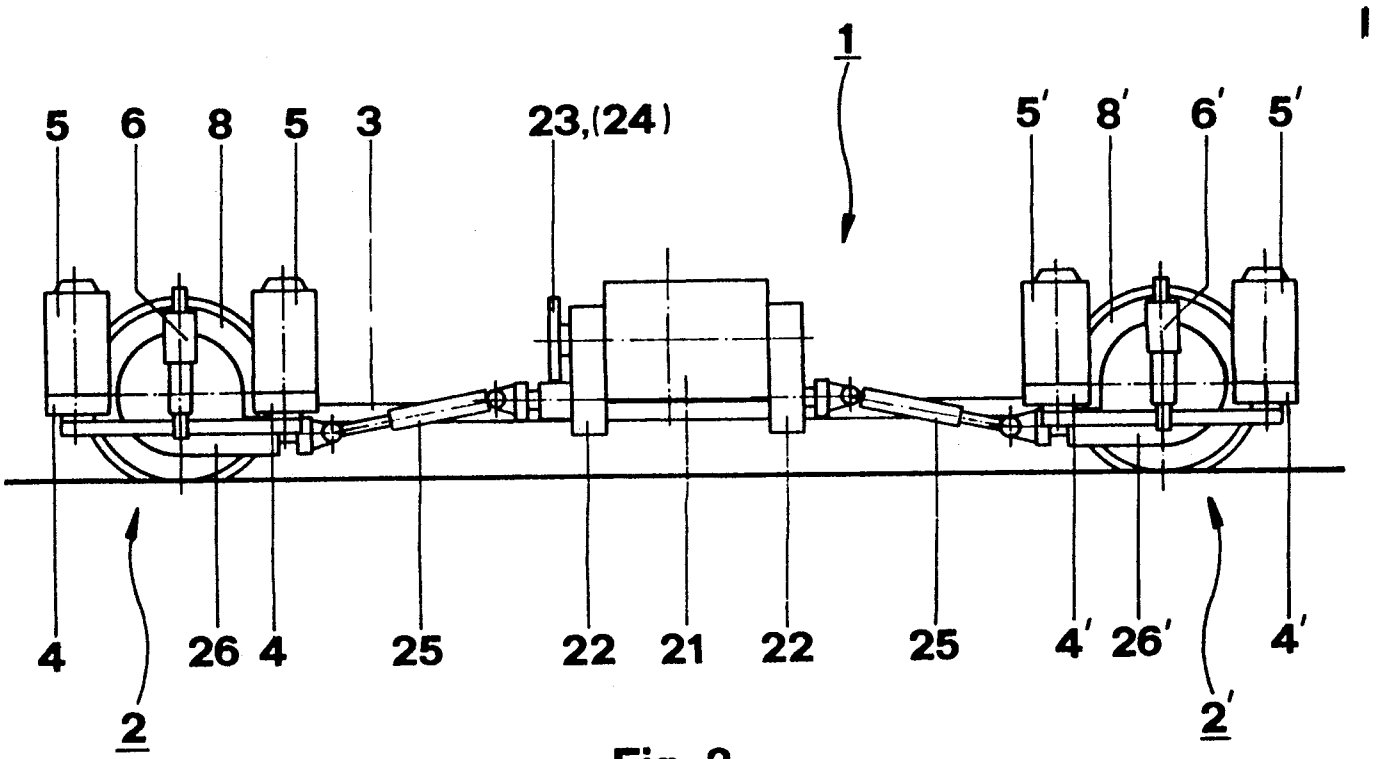
FIG. 2 is a side view of the running gear of FIG. 1.
Figure 3:
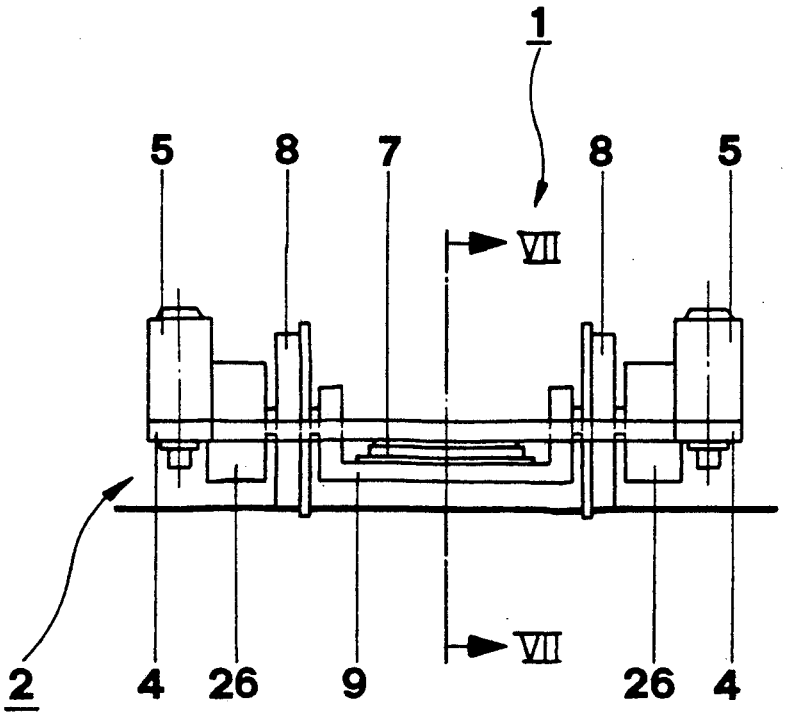
FIG. 3 is a front view of the running gear of FIG. 1.

A driven running gear 1 shown in FIGS. 1 to 3 consists of two individual-wheel sets of individual running gears 2, 2' of substantially the same construction which are steerable in opposite directions and are connected in inseparable manner with each other by a flexurally stiff and torsionally soft connecting member 3 which receives both the driving and braking forces and fixes their axial spacing.

In the present embodiment, each individual running gear 2, 2' is provided on all its outer corner points with four support arms 4, 4', lying below the axle center in order to receive a common low-platform body part.

The supporting of the body part B is effected, sprung in one step, on the outside of the wheel on a very large base on the support arms 4, 4' which are developed in an H-shape on the ends of the connecting member 3. In all, eight spring means 5, 5' arranged on the transversely directed support arms 4, 4' permit vertical springing and horizontal transverse springing of the body part and are damped, for instance per pair of springs, by a vertical damper 6, 6'.

For the turning-out movement as a result of travel along a curve, each individual running gear 2, 2' preferably has a known ball turning rim 7, 7' which rests with large surface on a downward bent wheel bridge 9, 9' which connects the two inner individual wheels 8, 8' with each other and thus makes the horizontal tilting of the wheel bridge 9, 9' in the individual running gear 2, 2' impossible.

By the arrangement of a ball turning rim described and in particular by the special development of the connecting member 3 for the simultaneous supporting of the body, the turning-out movement upon travel around curves is kept away from the spring means 5, 5'. In this way, the latter are acted on only vertically and horizontally-transversely and upon travel around a curve remain in unchanged position with respect to their supporting height and vertical position. A lowering of the body part upon tight curves, as known from flexi-stressed springs, is therefore avoided.

In this way the turning-out resistance of the individual running gears 2, 2' is reduced to a minimum, and adjustment in proper curve-radial position is made easier.

For the curve-radial positioning of the individual running gears 2, 2', the angle of bend between two adjacent body parts which are articulated to each other is first of all transmitted via a steering rod 11 to a toggle lever 12 mounted on the end side on the individual running gear 2 in the longitudinal center plane 10 with a rotary bearing 17 and thus deflected transverse to the direction of travel to a connecting rod 13 which acts on an extension 14 present on one side on the wheel bridge 9. For the opposite steering of the individual running gears 2, 2', each wheel bridge 9, 9' has a drawbar-like extension 15, 15' lying outside the longitudinal center plane 10, which extensions are connected to each other, facing each other in rotary symmetry, with a connecting rod 16 in the articulation points 18.

The longitudinal entrainment between body part and running gear takes place preferably via two longitudinal connecting rods 19 mounted on the individual running gear 2 at articulation points 18 and arranged, for instance, in parallel on both sides of the longitudinal center planes 10.

By the motorization shown, the two individual running gears 2, 2', which are connected with each other in the manner described above, become a driven running gear 1.

For this purpose, for instance on each longitudinal side of the running gear, a drive motor 21, 21' together with reduction gearings 22, 22', as well as brake discs 23, 23' present on the driven side thereof and the corresponding brake actuations 24, 24' are suspended from the sprung body part.

The transmission of force is effected from there, on both sides, by means of telescopic universal shafts 25, 25' to the bevel gearings 26, 26' arranged on each side of the outer side of the wheel on the stub shafts of the individual wheels 8, 8'.

Figure 4:
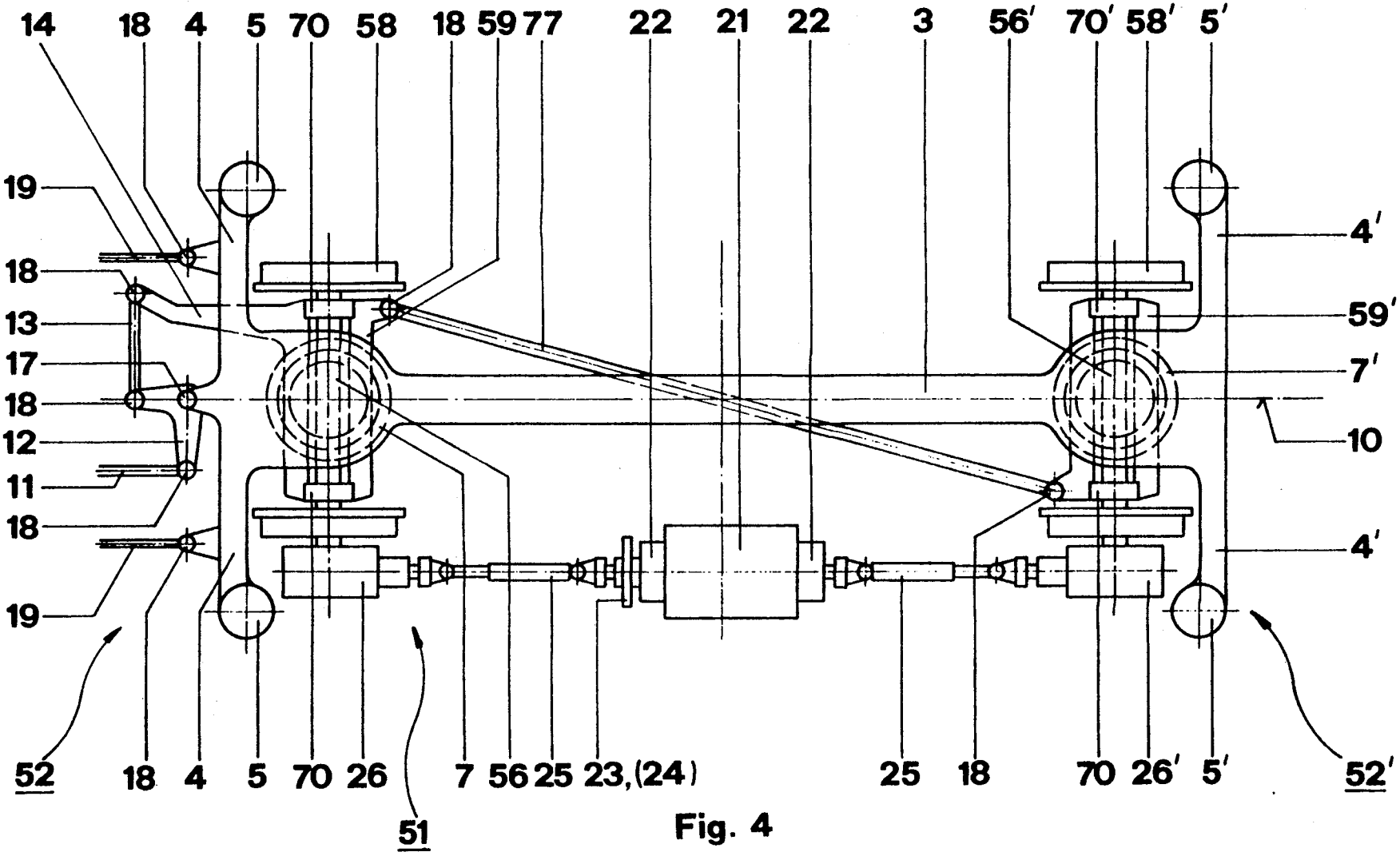
FIG. 4 is a running gear driven from one side with single-axle individual running gears seen in top view.
Figure 5:
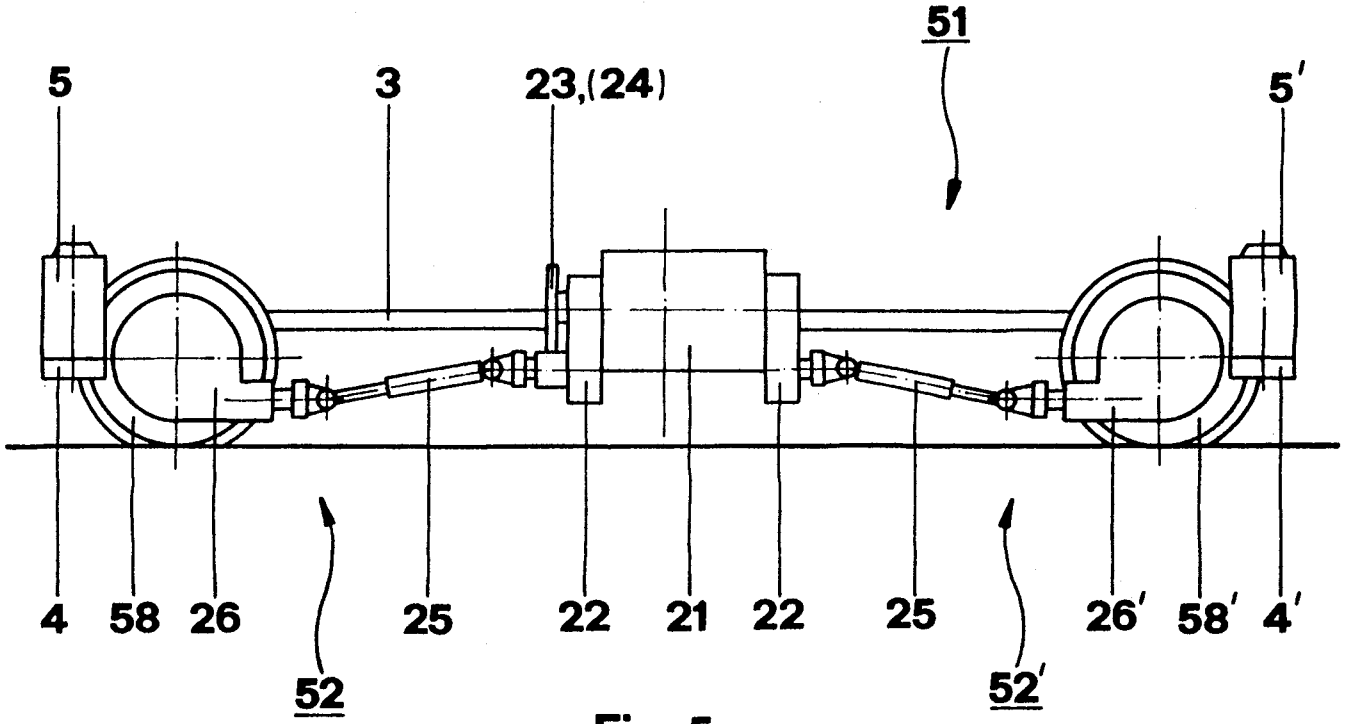
FIG. 5 is a side view of the running gear of FIG. 4.
Figure 6:
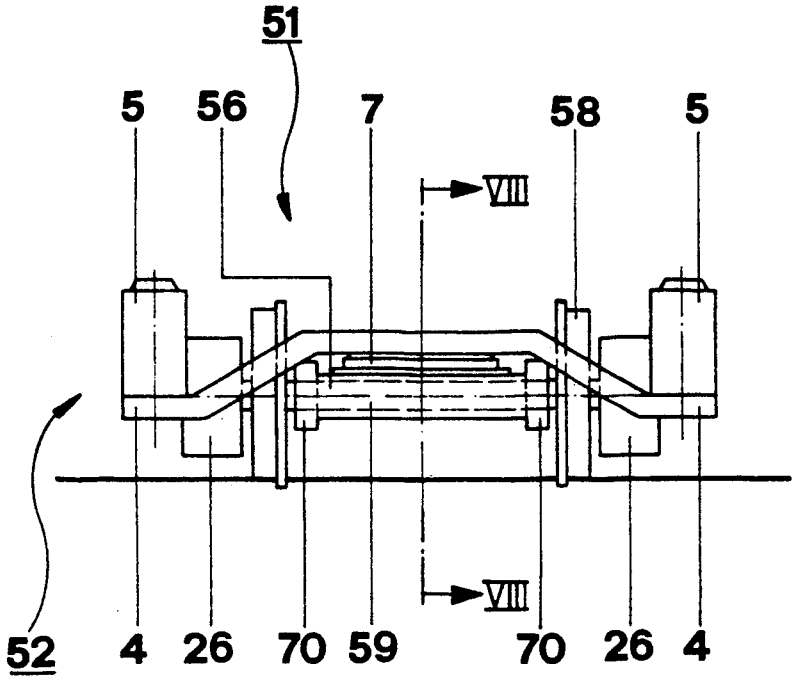
FIG. 6 is a front view of the running gear of FIG. 4.

FIGS. 4 to 6 show, a further preferred embodiment, a particularly light running gear 51 in accordance with the invention which consists of two oppositely steerable single-axle individual running gears 52, 52' which are substantially of the same construction and which are connected in a non-separable manner to each other by a flexurally rigid and torsionally soft connecting member 3 which establishes their center-to-center spacing and receives the drive and braking forces.

In the present embodiment, each individual running gear 52, 52' is provided at its outer corner points with two support arms 4, 4' lying below the center of the axle to receive a common low-platform body part.

The supporting of the body part is effected, sprung in one step, on the outside of the wheel on a very large base on the support arms 4, 4' developed in T-shape on the ends of the connecting member 3. A total of four spring means 5, 5' arranged on the transversely directed support arms 4, 4' permit vertical springing and horizontal transverse springing of the body part and are damped for instance per spring by a vertical damper 6, 6', not shown.

For the turning-out movement as a result of travel around curves, each individual running gear 52, 52' preferably has a known ball turning rim 7, 7' which rests with large area on an axle frame 59, 59' which is guided on both sides parallel to an axle 56, 56' and contains the inner mount 70, 70' of the wheel sets 58, 58' and thus prevents horizontal tilting of the axle frame 59, 59' in the individual running gear 52, 52'.

By the above-described arrangement of a ball turning rim 7, 7', and in particular by the special development of the connecting member 3 for the simultaneous supporting of the body, the turning-out movement is kept away from the spring means 5, 5' upon travel around curves.

In this way, the latter are merely acted on vertically and horizontally-transversely and remain in unchanged position with respect to their support height and vertical position upon travel along curves. In this way a lowering of the body part in the case of tight curves, as is known in the case of flexi-stress springs, is avoided.

In this way, the turning-out resistance of the individual running gears 2, 2' is reduced to a minimum and their easier placing in proper curve-radial position made possible.

The longitudinal entrainment and the placing of the individual running gears 52, 52' in their proper curve-radial position is effected in the same manner as already described with reference to FIGS. 1 to 3. For the opposite guiding of the individual running gears 52, 52', there is provided, diagonally offset from each other on each axle frame 59, 59', an articulation point 18, the two articulation points being connected by at least one connecting rod 77 passed obliquely below the connecting member 3.

By the motorization shown, the two individual running gears 52, 52', which are connected together in the manner described, are developed into a driven running gear 51.

For this purpose, a drive motor 21 and reduction gears 22 as well as a brake disc 23 present on the one driven side thereof and its corresponding brake actuation 24 are suspended on one longitudinal side of the running gear from the sprung body part.

The transmission of force takes place from there on both sides by means of telescopic universal shafts 25 to the bevel gearings 26, 26' arranged on one side of the outside of the wheel on the wheel sets 58, 58'.

By the arrangement in accordance with the invention, in the two above-described embodiments the forces of reaction coming from drive and brake as well as any differences in wheel diameter are taken up by this system, without the possibility of placing in proper curve-radial position being, for instance, impaired thereby.

At the same time, the torsionally soft connection of the two individual running gears satisfies all conditions for assurance against derailing with respect to non-uniform wheel pressures as well as changes in wheel load as a result of travel around curves in the case of winding tracks.

Figure 7:
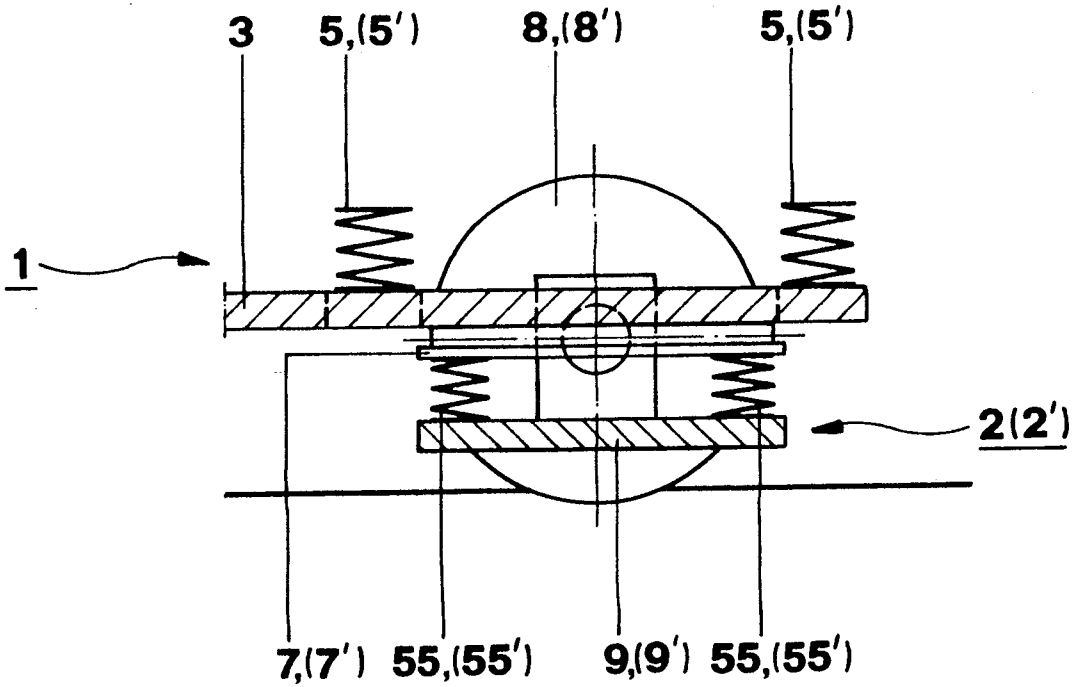
FIG. 7 shows a driven running gear along the section line VII—VII of FIG. 3, but with two-step springing.

FIG. 7 shows a driven running gear 1 such as described above, but having a two-stage springing of the body part. In this case, the additional spring means 55, 55' serving for the pure vertical springing are arranged between the wheel bridges 9, 9' and, in each case, a ball turning rim 7, 7'.

Figure 8:
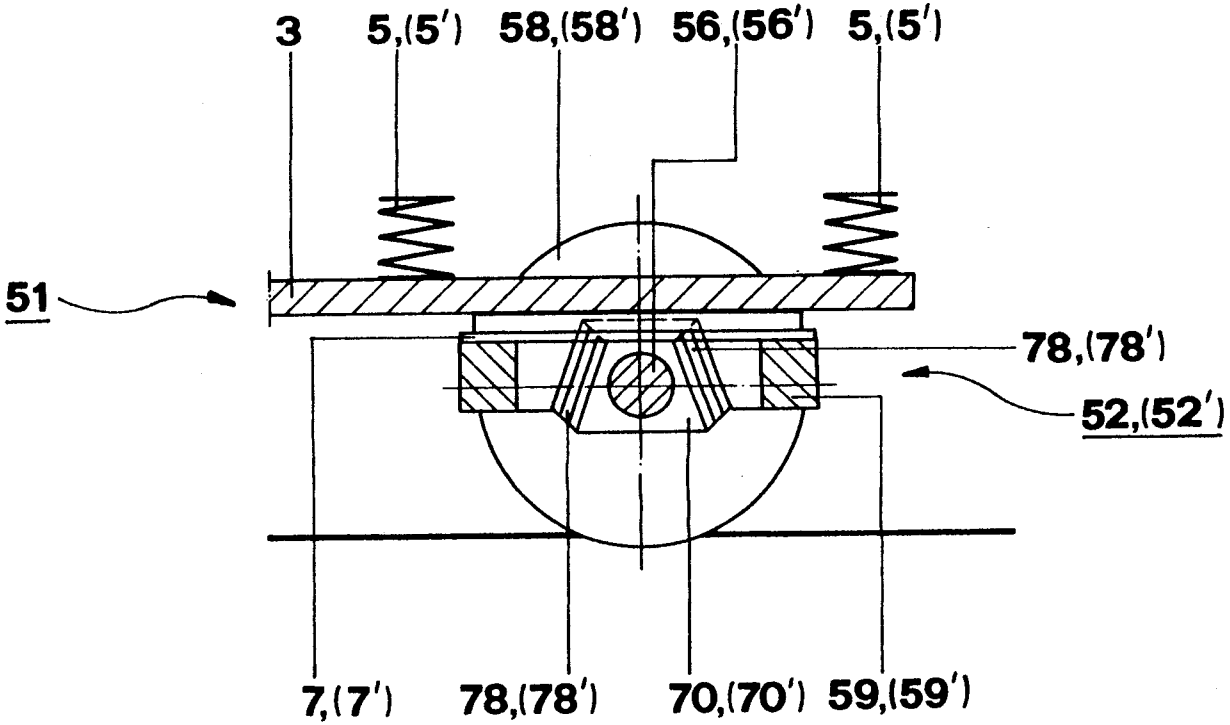
FIG. 8 shows a further embodiment of a two-step springing for a driven running gear seen along the section line VIII—VIII of FIG. 6.

Another possibility for a two-stage springing of the body part is shown in FIG. 8. In this case, the axle frames 59, 59' are supported, arranged on both sides along the inner mounting 70, 70', on known spring means 78, 78'.

As an alternative, in the case of a two-stage springing on both sides of the wheel bridge 9, 9' or of the axle frame 59, 59' and for the lowest possible construction, ball turning rim segments known per se, arranged nested in height with respect to them, are provided, which receive the spring means 55, 55'.

Figure 9:
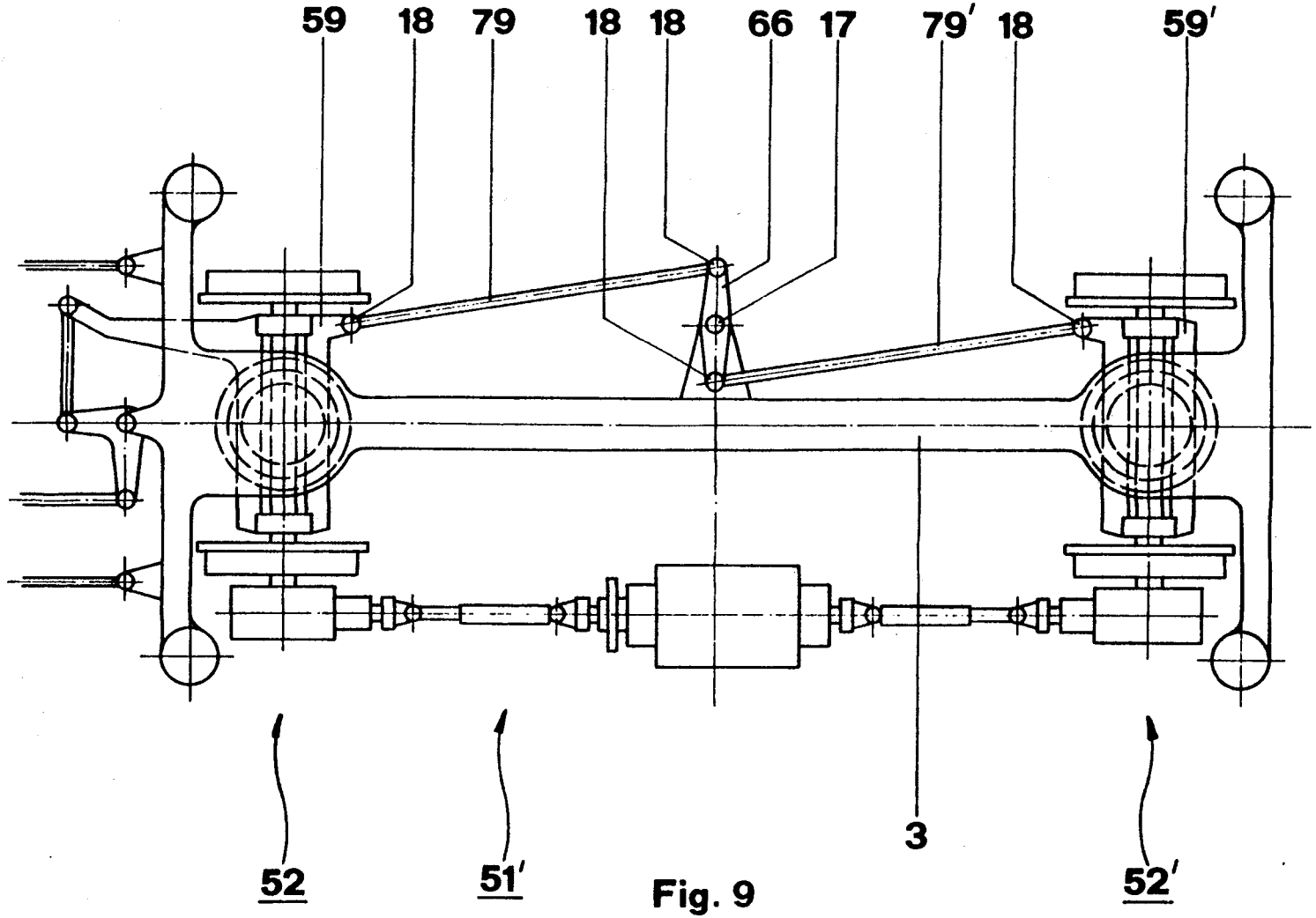
FIG. 9 shows a running gear driven from one side with individual-wheel individual running gears according to FIG. 4 and a variant of the curve control, seen in top view.

FIG. 9, on the example of a driven running gear 51 which has been previously described, shows a variant 51' with a different opposite steering of the individual running gears 52, 52'. In this case, a swing lever 66 is mounted rotatably in a bearing 17 on the connecting member 3 at half the axle spacing and connected at its articulation points 18 via connecting rods 79, 79' with the corresponding articulation points 18 of the two axle frames 59, 59' in the manner shown.

The embodiments of a driven running gear 1, 51, 51' shown in FIGS. 1 to 9 can also contain optional combination of the features shown (for instance drive, springing, steering). Accordingly, the general inventive concept of the invention is not to be considered as being limited to such embodiments, but rather is defined by the claims.

We claim:

1. A driven running gear arrangement for an articulated low-platform rail vehicle with a plurality of body parts, comprising:

two individual running gears having steering means, each of said running gears having a pair of inwardly mounted wheels and means permitting the wheels to swing in a horizontal plane about a central pivot, wherein said horizontal plane is located below the axial center of said wheels, wherein said central pivot is a ball turning rim disposed between a connecting member and a downwardly cranked wheel bridge, and wherein each of said individual running gears includes said downwardly cranked wheel bridge connecting said wheels;

said two running gears being connected to each other by said connecting member, said connecting member having support arms at opposing ends for supporting one body part of said vehicle, wherein said body part includes at least one motor and one brake suspended from the body part for driving and braking the running gears respectively through telescopic universal shafts and bevel gears disposed outside of said wheels.

2. A driven running gear according to claim 1, wherein said support arms lie in a plane below the axial center of said wheels and are formed of a T-shape disposed on an outer side of said wheels, said support arms including spring means for supporting said body part.

3. A driven running gear according claim 2, wherein each of said individual running gears includes an axle frame connecting said wheels, wherein said axle frame is guided on both sides and contains an inner mounting of a wheel set.

4. A driven running gear according to claim 3, wherein said support arms further include a second spring means providing a two stage springing of said body part, said second spring means disposed alongside said inner mounting.

5. A driven running gear according to claim 2, wherein said support arms further include a second spring means providing a two stage springing of said body part, said second spring means disposed between said wheel bridge and said ball turning rim.

6. A driven running gear according to claim 1, wherein each of said individual running gears includes an axle frame connecting said wheels, wherein said axle frame is guided on both sides and contains an inner mounting of a wheel set.

7. A driven running gear according to claim 6, wherein said steering means connects the axle frame of both of said individual running gears.

8. A driven running gear according to claim 7, wherein said steering means is disposed on both sides of said individual running gears.

9. A driven running gear according to claim 7, wherein said steering means is disposed on one side of said individual running gears.

10. A driven running gear according to claim 7, wherein said steering means is disposed diagonally across each side of said individual running gears.

11. A driven running gear according to claim 1, wherein said connecting member is constructed such that it is flexurally stiff along its longitudinal axis and torsionally soft at the support arms at its opposing ends.

12. A driven running gear according to claim 1, further comprising two longitudinal connecting rods mounted on articulation points providing longitudinal entrainment between said body parts and said running gear.

13. A driven running gear arrangement for an articulated low-platform rail vehicle with a plurality of body parts, comprising:

two individual running gears having steering means, each of said running gears having a pair of inwardly mounted wheels and means permitting the wheels to swing in a horizontal plane about a central pivot, wherein said horizontal plane is located below the axial center of said wheels;

said two running gears being connected to each other by a connecting member, said connecting member having support arms at opposing ends for supporting one body part of said vehicle, wherein said body part includes at least one motor and one brake suspended from the body part for driving and braking the running gears respectively through telescopic universal shafts and bevel gears disposed outside of said wheels; wherein said support arms lie in a plane below the axial center of said wheels and are formed of an H-shape surrounding said wheels, said support arms including spring means for supporting said body part.

14. A driven running gear according to claim 13, wherein each of said individual running gears includes a downwardly cranked wheel bridge connecting said wheels.

15. A driven running gear according to claim 14, wherein said central pivot is a ball turning rim disposed between said connecting member and said wheel bridge.

16. A driven running gear according to claim 15, wherein said support arm further include a second spring means providing a two stage springing of said body part, said second spring means disposed between said wheel bridge and said ball turning rim.

17. A driven running gear according to claim 13, wherein each of said individual running gears includes an axle frame connecting said wheels, wherein said axle frame is guided on both sides and contains an inner mounting of a wheel set.

18. A driven running gear according to claim 17, wherein said support arms further include a second spring means providing a two stage springing of said body part, said second spring means disposed alongside said inner mounting.

19. A driven running gear according to claim 13, wherein said spring means is dampened by a vertical damper.

20. A driven running gear arrangement for an articulated low-platform rail vehicle with a plurality of body parts, comprising:

two individual running gears having steering means, each of said running gears having a pair of inwardly mounted wheels and means permitting the wheels to swing in a horizontal plane about a central pivot, wherein said horizontal plane is located below the axial center of said wheels;

said two running gears being connected to each other by a connecting member, said connecting member having support arms at opposing ends for supporting one body part of said vehicle, wherein said body part includes at least one motor and one brake suspended from the body part for driving and braking the running gears respectively through telescopic universal shafts and bevel gears disposed outside of said wheels; wherein each of said individual running gears includes a downwardly cranked wheel bridge connecting said wheels.

21. A driven running gear according to claim 20, wherein said steering means connects the wheel bridges of both of said individual running gears.

22. A driven running gear according to claim 21, wherein said steering means is disposed on both sides of said individual running gears.

23. A driven running gear according to claim 21, wherein said steering means is disposed on one side of said individual running gears.

24. A driven running gear according to claim 21, wherein said steering means is disposed diagonally across each side of said individual running gears.

25. A driven running gear according to claim 20, wherein said central pivot is a ball turning rim disposed between said connecting member and said wheel bridge.

26. A driven running gear arrangement for an articulated low-platform rail vehicle with a plurality of body parts, comprising:

two individual running gears having steering means, each of said running gears having a pair of inwardly mounted wheels and means permitting the wheels to swing in a horizontal plane about a central pivot, wherein said horizontal plane is located below the axial center of said wheels;

said two running gears being connected to each other by a connecting member, said connecting member having support arms at opposing ends for supporting one body part of said vehicle, wherein said body parts includes at least one motor and one brake suspended from the body part for driving and braking the running gears respectively through telescopic universal shafts and bevel gears disposed outside of said wheels; wherein said connecting member has at least one pivot bearing, said driven running gear further comprising a steering linkage mounted on said pivot bearing for transmitting an articulation angle between said one body part and an adjacent body part of said articulated vehicle to said steering means through an extension member.

* * * * *